US011891738B2

(12) United States Patent
Demange

(10) Patent No.: US 11,891,738 B2
(45) Date of Patent: Feb. 6, 2024

(54) DEVICE FOR TRANSFERRING AND/OR INTRODUCING A FIBRE LAP, PARTICULARLY A NONWOVEN LAP, INTO A CONSOLIDATION INSTALLATION, IN PARTICULAR A NEEDLE LOOM

(71) Applicant: ANDRITZ ASSELIN-THIBEAU, Elbeuf (FR)

(72) Inventor: Frédéric Demange, Montville (FR)

(73) Assignee: Andritz Asselin-Thibeau, Elbeauf (FR)

( * ) Notice: Subject to any disclaimer, the term of this patent is extended or adjusted under 35 U.S.C. 154(b) by 21 days.

(21) Appl. No.: 17/622,320

(22) PCT Filed: Jul. 3, 2020

(86) PCT No.: PCT/EP2020/068806
§ 371 (c)(1),
(2) Date: Dec. 23, 2021

(87) PCT Pub. No.: WO2021/004931
PCT Pub. Date: Jan. 14, 2021

(65) Prior Publication Data

US 2022/0251750 A1 Aug. 11, 2022

(30) Foreign Application Priority Data

Jul. 11, 2019 (FR) ..... 19 07828

(51) Int. Cl.
*D04H 18/02* (2012.01)

(52) U.S. Cl.
CPC ..... *D04H 18/02* (2013.01)

(58) Field of Classification Search
CPC ..... D04H 18/00; D04H 18/02; D04H 18/04; D04H 1/70; D04H 1/46; D04H 1/736;
(Continued)

(56) References Cited

U.S. PATENT DOCUMENTS 2,486,903 A * 11/1949 Wormell ..... D01D 10/049 34/500
4,170,676 A * 10/1979 Thomas ..... B32B 5/14 428/113

(Continued)

FOREIGN PATENT DOCUMENTS

CN 205529366 U * 8/2016
DE 4234355 A1 4/1994

(Continued)

OTHER PUBLICATIONS

English language translation of WO 2018/162624 (LeRoy) Pub. Sep. 2018.*

(Continued)

*Primary Examiner* — Amy Vanatta
(74) *Attorney, Agent, or Firm* — Renner, Kenner, Greive, Bobak, Taylor & Weber

(57) ABSTRACT

Device for transferring and/or introducing a fibre web, in particular a nonwoven web, into a consolidation installation, in particular one that is mechanical or hydraulic, for example a needle loom, comprising at least one transfer element comprising at least one roller (12), at least one saber (16) and an endless belt (13) extending between an upstream end and a downstream end so as to wrap around the roller at the upstream end and the saber at the downstream end, the at least one roller being arranged so as to drive the endless belt in rotation, and the at least one saber giving the downstream end of the belt the shape of a corner or lip, the at least one endless belt (13) being modular and consisting of links in the form of transverse strips that are articulated to one another, characterised in that the endless belt (13) consists of a plurality of sub-belts extending parallel to one another.

15 Claims, 5 Drawing Sheets

(58) Field of Classification Search
CPC .. D04H 1/74; D04H 1/72; D04H 5/02; D04H 3/102; D04H 3/105; B65G 15/12; B65G 17/08; B65G 15/10; B65G 15/18; B65G 15/20; B65G 15/50; D01G 25/00; D01G 21/00; B65H 20/00; B65H 27/00; B65H 31/28
USPC ..... 26/18.5, 18.6; 198/817
See application file for complete search history.

(56) References Cited

U.S. PATENT DOCUMENTS

| | | | | |
|---|---|---|---|---|
| 4,436,296 | A | 3/1984 | Fonio | |
| 4,467,718 | A * | 8/1984 | Held | B30B 5/04 100/151 |
| 4,606,533 | A * | 8/1986 | Fonio | B65H 45/103 242/564.3 |
| 5,031,289 | A * | 7/1991 | LeRoy | D04H 18/02 28/107 |
| 5,307,546 | A * | 5/1994 | Dilo | D04H 18/02 28/107 |
| 5,501,147 | A * | 3/1996 | Jaffa | B65H 29/54 101/118 |
| 6,385,825 | B1 * | 5/2002 | Wang | D04H 18/00 28/107 |
| 6,464,065 | B2 * | 10/2002 | Herubel | B65G 47/31 198/460.1 |
| 6,634,069 | B2 * | 10/2003 | Dilo | D04H 18/00 28/112 |
| 2007/0187211 | A1 * | 8/2007 | Vertogen | B65G 15/50 198/461.1 |

FOREIGN PATENT DOCUMENTS

| | | | | |
|---|---|---|---|---|
| EP | 3015578 | A1 * | 5/2016 | D01G 25/00 |
| FR | 2484975 | A1 | 12/1981 | |
| WO | 2018162624 | A1 | 9/2018 | |

OTHER PUBLICATIONS

International Search Report dated Sep. 14, 2020 in related application No. PCT/EP2020/068806.

* cited by examiner

[Fig. 1]
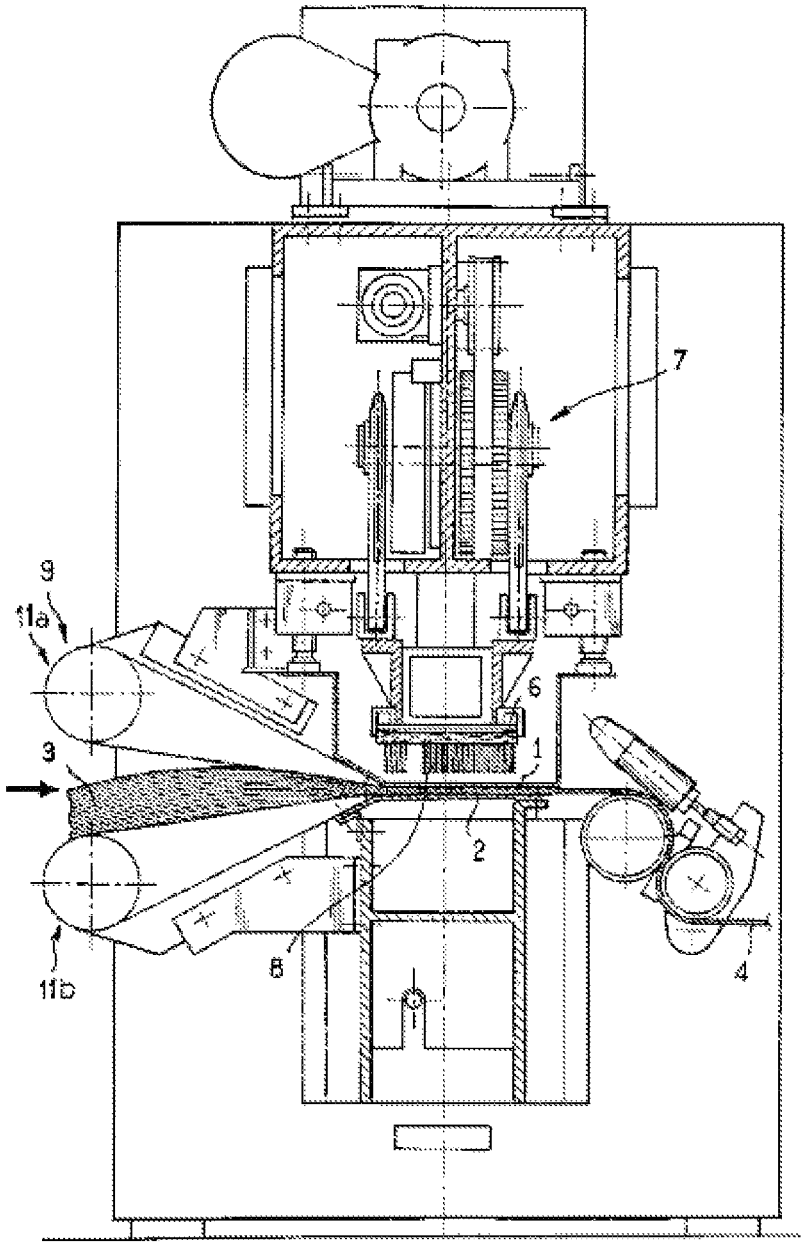

[Fig. 2]
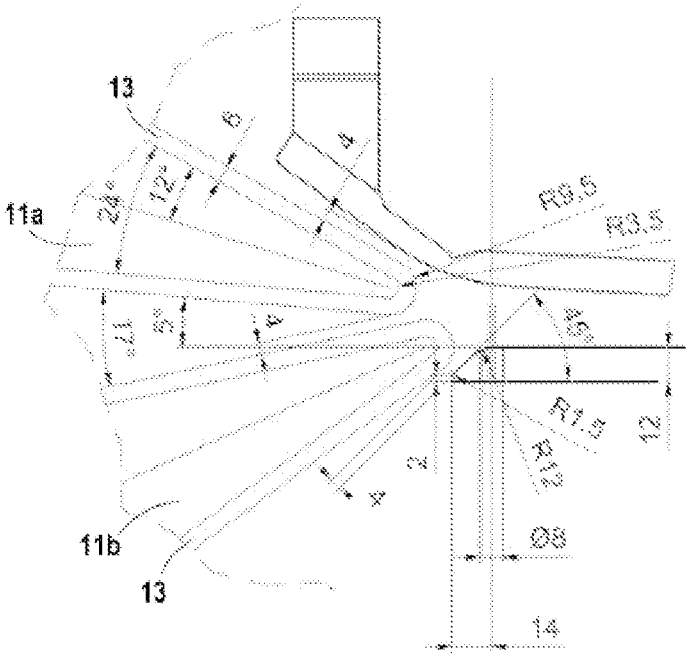

[Fig. 3]
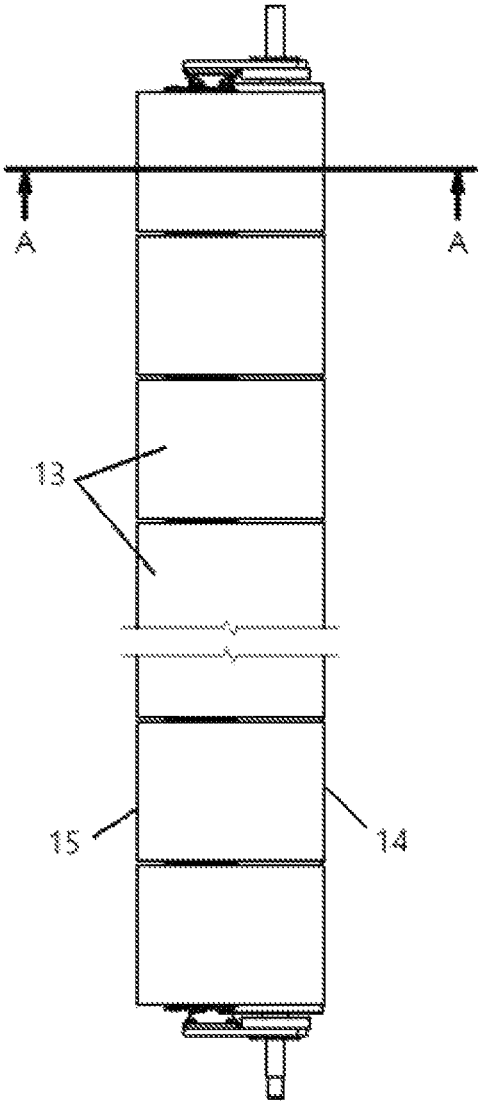

[Fig. 4]
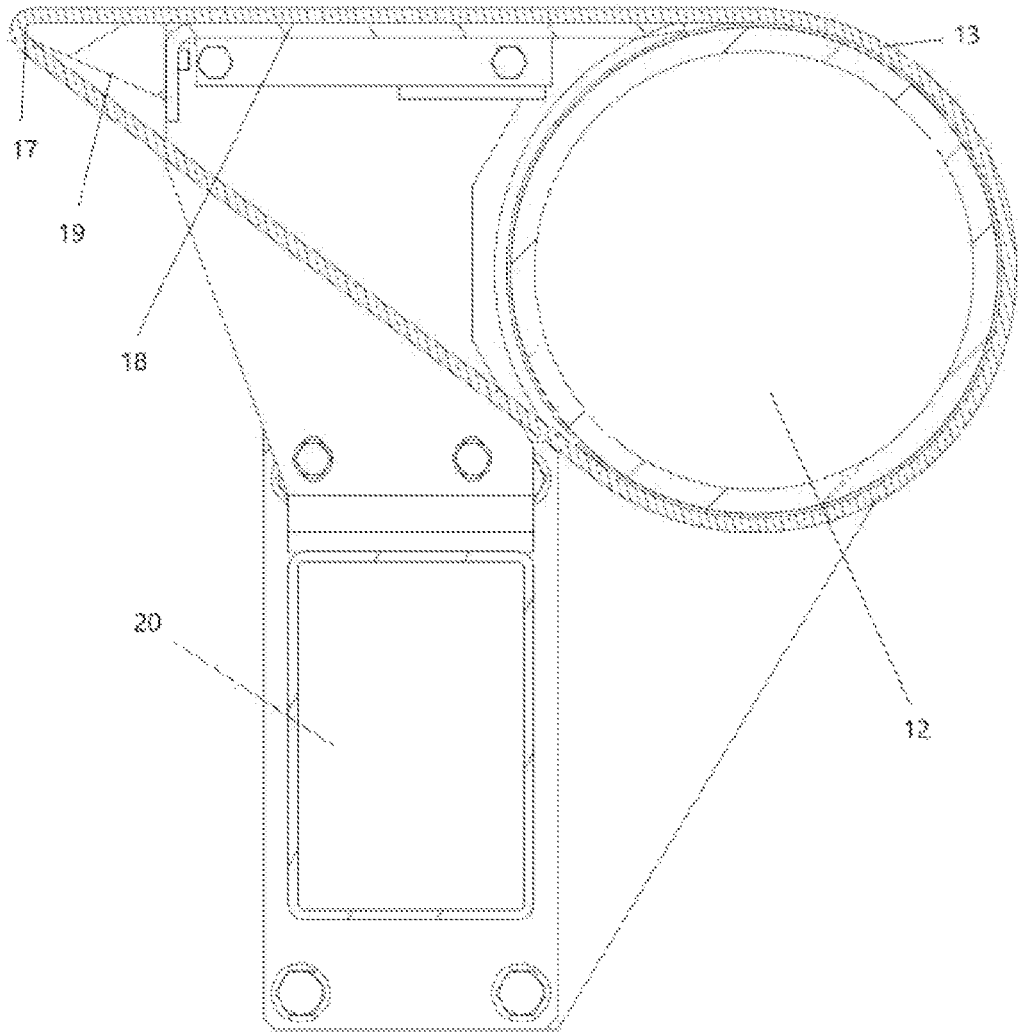
Fig 5
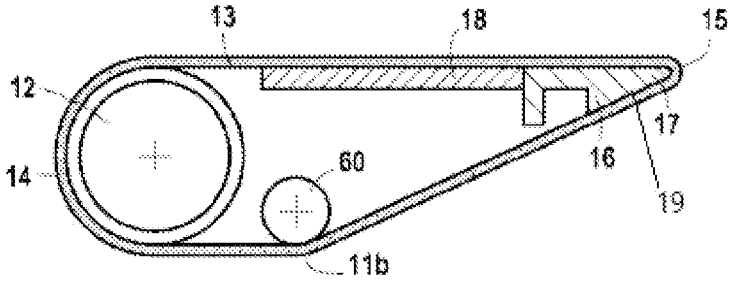

[Fig. 6]
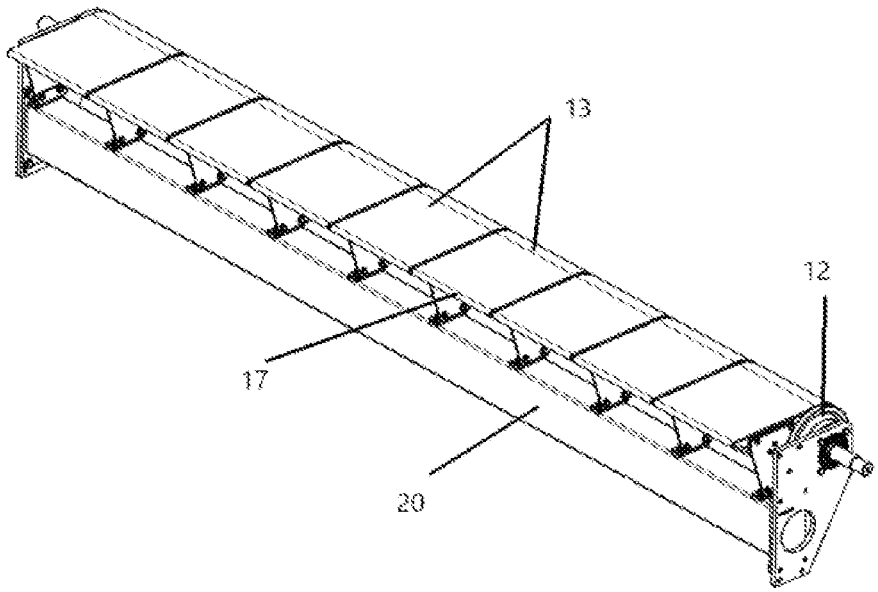
Fig 7
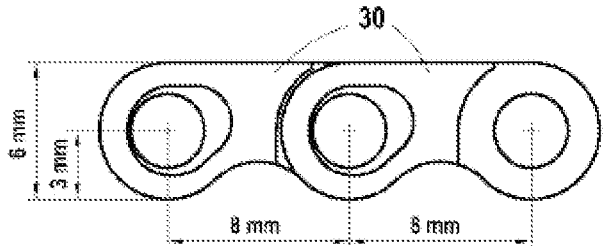

DEVICE FOR TRANSFERRING AND/OR INTRODUCING A FIBRE LAP, PARTICULARLY A NONWOVEN LAP, INTO A CONSOLIDATION INSTALLATION, IN PARTICULAR A NEEDLE LOOM

TECHNICAL FIELD

The present invention relates to a device for transferring and/or introducing a fibre lap or web, particularly a nonwoven lap or web, into a consolidation installation, in particular a needle loom.

BACKGROUND

French patent application FR 3063742A1 under the applicant's name already discloses a transfer device that introduces a fibre web from a crosslapper onto the support table of a needle loom. The device comprises two elements, upper and lower respectively, which define between them a gap, the thickness of which decreases in the direction of the needle loom and through which the web passes, each element comprising a roller, a saber and an endless belt wrapping around the upstream roller and the downstream saber, the roller driving the endless belt in rotation, and the saber giving the downstream end of the belt the shape of a corner or beak, the endless belt consisting of a modular belt manufactured in the form of a succession of links in the form of transverse strips that are articulated to one another, FR 2 484 975 A1 describes a feed device for a web material on a folding machine table, comprising conveyor belts for a web to be folded which extends between cylindrical rollers which feed an intermediate transporter in the region of an end roller, said intermediate transporter itself transferring the web to be folded onto the folding table, at a distance from the end roller.

SUMMARY OF THE INVENTION

DE 42 34 355 A1 describes a device for transferring a fibre web to a needle loom. The transfer device comprises a plurality of intermediate elements between a endless belt with a saber at the end thereof and the needle loom.

Although the transfer device according to FR 3063742A1 represents considerable progress compared with what existed previously, particularly in allowing the web to be consolidated to be brought as close as possible to the consolidation working area, in particular as close as possible to the working area of the needles of a needle loom, while considerably reducing any processing that needs to be performed on the web, for example by avoiding any stretching, in particular thanks to the fact that the downstream end of the belt can be manufactured such that it is very thin, this device of the prior art does, however, have a disadvantage when they are very wide. In particular, the belt often becomes jammed, causing an undesirable stoppage of the production line.

The present invention seeks to overcome the disadvantages of the prior art by proposing a transfer device which, while allowing the downstream end of the endless belt or belts to be positioned as close as possible to the consolidation device, thus avoiding stretching the web which might lead to damage to said web, avoids unscheduled interruptions on the production line in the event of very wide devices.

According to the invention, a device for transferring and/or introducing a fibre web, in particular a nonwoven web, into a consolidation installation, in particular one that is mechanical or hydraulic, for example a needle loom, comprising at least one transfer element comprising at least one roller, at least one saber and a endless belt extending between an upstream end and a downstream end so as to wrap around the roller at the upstream end and the saber at the downstream end, the at least one roller being arranged so as to drive the endless belt in rotation, and the at least one saber giving the downstream end of the belt the shape of a corner or beak, the at least one endless belt being modular and consisting of links in the form of transverse strips that are articulated to one another, is characterised in that the endless belt consists of a plurality of sub-belts extending parallel to one another, preferably with the same width, smaller than the total width of the belt, preferably at a distance from one another.

By thus providing a plurality of endless sub-belts with a small width, for example between 7 and 30 sub-belts, in particular between 8 and 15 sub-belts, it is possible to prevent the wide belt, which is very thin at its downstream end, from twisting over itself and causing the machine to stop, each sub-belt having a much greater inherent stability and thus being less likely to twist given its reduced width and low amplitude variation in the transverse direction compared with a single, very wide belt that is equal to the sum of the smaller widths of the sub-belts.

According to a preferred embodiment of the invention, the roller comprises circumferential ribs that protrude from the side surface of the roller and are separated from one another by a distance corresponding substantially to the said smaller sub-belt width to thus guide each sub-belt more expediently in its direction of displacement.

According to a preferred embodiment of the invention, the element comprises a plurality of sabers at the downstream end, a saber corresponding to a sub-belt.

Preferably, the sub-belts have widths, measured in direction CD, which are less than their respective length, measured in direction MD, in particular than the distance from the upstream end to the downstream end, whereas the belt as a whole has a width, measured in direction CD, which is greater than its length, measured in direction MD, or the displacement direction of the belts, in particular substantially greater than its length, in particular approximately five times greater.

According to a preferred embodiment of the invention, the sub-belts are separated from one another, in particular by a distance of between 6 mm and 15 mm.

According to a preferred embodiment, each sub-belt has a width, measured in the direction referred to as CD, i.e. horizontal, perpendicular to the upstream-downstream direction (this upstream-downstream direction being referred to as direction MD), of between 20 cm and 50 cm, in particular between 30 cm and 40 cm.

Preferably, the width (measured in direction MD) of a transverse strip, i.e. the pitch of each modular sub-belt, is between 6 mm and 15 mm.

According to a preferred embodiment, the inner bending radius of each sub-belt in the region of their downstream end is 3.5 mm, for example, and may in particular be between 2 mm and 5 mm.

According to a preferred embodiment, the outer bending radius of the belt or each sub-belt in the region of their downstream end is in particular between 6 mm and 12 mm.

Preferably, the device comprises two transfer elements, upper and lower respectively, which define between them a gap through which the web passes during transfer, preferably by defining between them a gap with a thickness that decreases from upstream to downstream.

Preferably, the downstream end of one of the elements is set back, i.e. further upstream compared with the downstream end of the other element.

The present invention also relates to an assembly comprising a consolidation device, in particular one that is mechanical and/or hydraulic, for example a needle loom and a device according to the invention, and to an installation comprising a crosslapper and an assembly according to the invention.

By way of example, a preferred embodiment of the invention will now be described with reference to the drawings in which:

BRIEF DESCRIPTION OF THE DRAWINGS

FIG. 1 shows an assembly according to an embodiment of the invention comprising a device for transferring and/or introducing according to an embodiment of the invention and a needle loom;

FIG. 2 is a longitudinal sectional view of the interface between the end of the lower and upper transfer elements and the plates of the table and stripper of a needle loom showing, in particular, the position of the first needle in relation to the transfer device in FIG. 1;

FIG. 3 is a plan view of the lower transfer element from FIG. 1;

FIG. 4 is a longitudinal sectional view according to section AA in FIG. 3;

FIG. 5 is a view of part of another arrangement equivalent to the arrangement in FIG. 4;

FIG. 6 is a perspective view of the lower element from FIG. 1; and

FIG. 7 is a longitudinal sectional view of part of an endless sub-belt of the device in the preceding figures.

DETAILED DESCRIPTION OF THE INVENTION

FIG. 1 shows an assembly comprising a needle loom with an upper plate 1 referred to as a stripper and a lower plate 2 referred to as a table which, between them, define a substantially horizontal needle loom passage into which a web 3 is fed, said web, although it enters in the state of a web formed of fibres which are not connected or are minimally connected to each other, leaving in the state of a needle-punched web or mat 4. A needle board 6 is connected to a back-and-forth displacement mechanism 7 such that the needles 8 carried by the board 6 enter the needle loom passage through appropriate orifices in the table 1 and leave said passage, at a determined frequency. In a known manner, this interlaces the fibres of the web 3 and provides cohesion and mechanical strength to the web 4 obtained at the exit.

Upstream of the needle loop passage, the assembly according to the invention comprises a transfer and/or introduction device 9, the purpose of which is to transfer the fibre or nonwoven web 3 from a crosslapper (not shown in the figures), with the least possible stretching, to the needle loom passage. The device 9 may also have a web pre-compression function.

The introduction device 9 comprises an upper transfer element 11*a* and a lower transfer element 11*b*, which are substantially identical. The lower element 11*b* is described below. The same description applies to the upper element 11*a*.

The transfer element 11*b* comprises a frame 20 on which is supported a roller 12 or a transverse shaft equipped with a large number of pinions distributed over the width, located at the upstream end of the element 11*b* of the device 9. According to another embodiment, the drive for the belt, using pinions, may be replaced, in a favourable manner, by cladding the roller or the transverse shaft with a so-called friction drive material.

The roller 12 is driven in rotation by an associated motor and drives endless sub-belts 13 in rotation. Each endless sub-belt 13 defines a transport route that extends between an upstream end 14, where it wraps around the roller 12, and a downstream end 15, where it wraps around a respective saber 16 in order to form a kind of lip in longitudinal section. The belt 13 wraps around the edge 17 of the saber 16, which is on the opposite side to the roller 12.

The edge 17 of each saber 16 is chamfered in a cylindrical manner. Its bending radius, which corresponds to the inner bending radius of the belt in the region of its downstream end, is, for example, 3.5 mm and may in particular be between 2 mm and 5 mm. In turn, the outer bending radius of the belt in the region of its downstream end is, for example, 9.5 mm and may in particular be between 6 mm and 12 mm.

In the embodiment shown in FIG. 5, the edge 17 is adjacent to two flat faces 18 and 19 of the saber, the belt 13 being supported on said faces along its outward transport route and along its return route towards the roller 12. The upper 18 and lower 19 faces converge towards the edge 17 at an angle of 24° (see FIG. 2) and which may be between 10° and 35°. However, according to another possible arrangement, as shown in FIG. 4, the belt cannot rest against the lower flat face 19 of the saber, passing said face at a distance. In addition, compared with the arrangement in FIG. 4, FIG. 5 provides for an intermediate roller 60 arranged between the roller 12 and the lower face 19 of the saber 16.

As can be seen in FIG. 2, the downstream end of the upper element 11*a* is set back, i.e. further upstream, compared with the downstream end of the lower element 11*b*. On the other hand, the two elements are not arranged symmetrically with respect to the horizontal, but with respect to a plane that is inclined upwards towards the needle loom, in particular at an angle of approximately 8°, and which may be between 5° and 20°. In particular, the lower face 19 of the belt of the upper element is inclined slightly downwards (in the upstream-downstream direction), particularly at an angle of 5° with respect to the horizontal, whereas the upper face 18 of the lower element is inclined upwards at an angle of 12° with respect to the horizontal.

According to the invention, a plurality of sub-belts 13 are provided, each manufactured in the form of so-called micro-pitch modular belts, several segments thereof in the form of strips being shown in longitudinal section in FIG. 7. Each modular sub-belt 13 comprises longitudinal segments 30 in the form of individual transverse strips extending parallel to the axis of the roller 12 and articulated to one another in the region of their side edge, the width (i.e. the dimension in the upstream-downstream or MD direction of the belt) of a segment defining the pitch of the belt. This pitch is referred to as a micro-pitch and may be equal to 8 mm, in particular between 6 mm and 15 mm, preferably between 6 mm and 10 mm.

Each sub-belt has a width, measured in direction CD, i.e. the horizontal direction perpendicular to direction MD, of between 20 and 50 cm, in particular between 30 and 40 cm.

The sub-belts are separated from one another, i.e. the longitudinal edges (in direction MD) of two contiguous belts do not touch one another. In particular, they are separated by a distance of between 6 mm and 15 mm.

In particular, it is possible to provide between 5 and 30 sub-belts, in particular between 8 and 15 sub-belts, for example 9 or 10 sub-belts for an overall belt width of between 2 and 8 metres, in particular between 2.5 and 4 metres, for example 3 metres.

By thus providing a plurality of modular sub-belts, it is possible to obtain a very thin belt thickness, particularly in the region of the edge 17 of the saber 16, to allow the gap formed between the two transfer elements 11*a* and 11*b* to be extended to a point that is very close to the entrance to the needle loom, whilst avoiding jamming the line, the sub-belts, each having a smaller width (in direction CD), being less likely to twist over on themselves compared with a belt with a greater width, which is equal to the sum of the said smaller widths of the sub-belts.

Preferably, whereas the belt as a whole has a width that is greater than its length (measured in direction MD, or the displacement direction of the belts), in particular substantially greater than its length, in particular approximately five times greater, the sub-belts have widths that are less than their respective length (in direction MD), in particular than the distance from the upstream end to the downstream end.

Direction MD is the machine direction, i.e. the direction in which the belt moves, and direction CD is the transverse, horizontal direction, perpendicular to direction MD.

The invention claimed is:

1. A device for transferring and/or introducing a fibre web into a consolidation installation, comprising at least one fiber web and at least one transfer element comprising at least one roller (12), at least one saber (16) and an endless belt (13) extending between an upstream end and a downstream end so as to wrap around the roller at the upstream end and the saber at the downstream end, the at least one roller being arranged so as to drive the endless belt in rotation, and the at least one saber giving the downstream end of the belt the shape of a corner or beak, the at least one endless belt (13) being modular and comprising links in the form of transverse strips that are articulated to one another, said at least one fiber web being transported by said endless belt from said upstream end to said downstream end, characterised in that the endless belt (13) comprises a plurality of sub-belts extending parallel to one another, wherein the sub-belts have respective widths, measured in direction CD, which are each less than their respective length being the distance, measured in direction MD, from the upstream end to the downstream end, whereas the belt has a width, measured in direction CD, which is greater than its length, measured in direction MD, the lengths of the sub-belts being all equal.

2. The device according to claim 1, characterised in that the sub-belts have a same width, which is less than the total width of the belt.

3. The device according claim 1, characterised in that the sub-belts are at a distance from one another.

4. The device according to claim 1, characterised in that the sub-belts are at a distance from one another that is between 6 mm and 15 mm.

5. The device according to claim 1, characterised in that between 7 and 30 sub-belts are provided.

6. The device according to claim 1, characterised in that the or each transfer element comprises a plurality of sabers at the downstream end, a saber corresponding to a sub-belt.

7. The device according to claim 1, characterised in that each sub-belt has a width, measured in the direction perpendicular to the.

8. The device according to claim 1, characterised in that an inner bending radius of each sub-belt in the region of its downstream end is between 2 mm and 5 mm.

9. The device according to claim 1, characterised in that an outer bending radius of each belt or sub-belt in the region of its downstream end is between 6 mm and 12 mm.

10. The device according to claim 1, characterised in that the width, measured in direction MD, of a transverse strip is between 6 mm and 15 mm.

11. An assembly comprising a mechanical or hydraulic consolidation device and a device according to claim 1.

12. An installation comprising a crosslapper and an assembly according to claim 11.

13. The device according to claim 1, characterised in that between 8 and 15 sub-belts are provided.

14. The device according to claim 1, characterised in that each sub-belt has a width, measured in the direction CD, of between 30 cm and 40 cm.

15. An assembly comprising at least one fiber web and a device for transferring and/or introducing said at least one fibre web into a consolidation installation, said device comprising at least one transfer element comprising at least one roller (12), at least one saber (16) and an endless belt (13) extending between an upstream end and a downstream end so as to wrap around the roller at the upstream end and the saber at the downstream end, the at least one roller being arranged so as to drive the endless belt in rotation, and the at least one saber giving the downstream end of the belt the shape of a corner or beak, the at least one endless belt (13) being modular and comprising links in the form of transverse strips that are articulated to one another, said at least one fiber web being transported by said endless belt from said upstream end to said downstream end, characterized in that the endless belt (13) comprises a plurality of sub-belts extending parallel to one another, wherein the sub-belts have respective widths, measured in direction CD, which are each less than their respective length being the distance, measured in direction MD, from the upstream end to the downstream end, whereas the belt has a width, measured in direction CD, which is greater than its length, measured in direction MD, the lengths of the sub-belts being all equal.

* * * * *